United States Patent [19]

Matsumoto et al.

[11] Patent Number: 4,848,672

[45] Date of Patent: Jul. 18, 1989

[54] DESCALING NOZZLE

[75] Inventors: Kozo Matsumoto; Hiroyoshi Asakawa, both of Nishinomiya, Japan

[73] Assignee: Kyoritsu Gokin Mfg. Co., Ltd., Nishinomiya, Japan

[21] Appl. No.: 115,832

[22] Filed: Oct. 30, 1987

[51] Int. Cl.[4] ..... B05B 1/14

[52] U.S. Cl. ..... 239/590.5

[58] Field of Search ..... 138/39, 40; 29/81 B; 239/590, 590.3, 590.5, 552, 568

[56] References Cited

U.S. PATENT DOCUMENTS

| | | | |
|---|---|---|---|
| 597,842 | 1/1898 | Edmands | 239/590.5 |
| 2,273,803 | 9/1966 | Hall | 239/590.3 |
| 2,341,859 | 2/1944 | Edwards | 239/590 |
| 2,681,830 | 6/1954 | Peterman | 239/590.5 |
| 3,486,700 | 12/1969 | Bristow | 239/590.5 |
| 3,510,065 | 5/1970 | Gigantino et al. | 239/590.3 |
| 3,921,912 | 11/1975 | Hayes | 239/590.5 |

FOREIGN PATENT DOCUMENTS

| | | |
|---|---|---|
| 3917657 | 2/1964 | Japan . |
| 4323197 | 8/1964 | Japan . |

*Primary Examiner*—Andres Kashnikow
*Assistant Examiner*—Kevin P. Weldon
*Attorney, Agent, or Firm*—Gifford, Groh, Sheridan, Sprinkle and Dolgorukov

[57] ABSTRACT

A descaling nozzle having a straightening passage incorporating a straightener, a constricted passage communicating with a downstream side of the straightening passage and a jetting passage communicating with a dowstream side of the constricted passage. The jetting passage has a jetting opening at a bottom of a groove defined at a top end face thereof in the direction of diameter of the same. Axes of the straightening, constricted and jetting passages are aligned on the same straight line. The straightening passage has the same radius through its whole or substantially whole length and the constricted passage has a radius tapering from its upstream end to its downstream end or to a vicinity of the same.

3 Claims, 5 Drawing Sheets

DESCALING NOZZLE

BACKGROUND OF THE INVENTION

1. FIELD OF THE INVENTION

The present invention relates to a descaling nozzle for eliminating scale formed on a surface of a rolled steel plate through a linear jetting operation of highly-pressurized fluid (e.g. water) onto the surface, and more particularly to a descaling nozzle comprising a straightening passage including a straightener, a constricted passage communicating with downstream of the straightening passage and a jetting passage having a jetting opening at a bottom of a groove defined at a top end face thereof in the direction of diameter of the same with axes of the straightening, constricted and jetting passages being aligned on the same straight line.

2. DESCRIPTION OF PRIOR ART

There is a known descaling nozzle of the above-described type as disclosed, for example, in a Japanese patent application published under SHOWA No. 43-23197. According to this conventional descaling nozzle, of the above constricted passage, an upstream passage portion has the same radius throughout its overall length and at the same time a downstream passage portion has a radius tapering towards the downstream side.

However, in the case of this descaling nozzle, although the straightening passage and the upstream passage portion of the constricted passage have the same radius each other, the straightening passage, as incorporating the straightener, has an actual passage section smaller than that of the upstream passage portion and the passage section area varies suddenly between the straightening passage and the constricted passage. As the result, although the fluid is once straightened through the straightening passage, the fluid is again disturbed with a vortex flow when entering the constricted passage. Therefore, in spite of the straightening passage, the fluid enters the jetting passage often in the form of the vortex flow again and the linearly-jetted fluid also becomes disturbed with its thickness becoming unnecessarily large. Consequently, these result in decrease or unevenness in collisional force of the jetted fluid and in deterioration of descaling efficiency of the nozzle.

Also, though not relating to a descaling nozzle, there is another known nozzle disclosed in a Japanese utility model application published under SHOWA No. 39-17657. In the case of this nozzle, the straightening passage and the constricted passage are formed as one continuous passage having a radius gradually decreasing towards its downstream side. It is conceivable that this art may be employed for forming a descaling nozzle. In this case, since the area of the passage section of the constricted passage becomes gradually reduced towards the downstream side and the same finally becomes equal to that of the downstream portion of the straightening passage at a position adjacent the upstream straightening passage, it is possible to prevent the generation of vortex flow at the time of the entrance of the fluid from the straightening passage into the constricted passage. However, since the straightening passage also has its radius gradually reduced towards the downstream side, there occur problems to be described next.

In the case of the above-described construction, the following arrangement is required of the straightener.

That is, an outer periphery of the straightener, which is to come into contact with a peripheral wall of the straightening passage, and the peripheral wall need precisely inclined relative to an axis of the straightening passage. Such axially inclined alignment of the outer periphery of the straightener is much more difficult compared with e.g. a parallel alignment of the same relative to the axis of the straightening passage, thereby resulting in a cost increase of the straightener. Also, in the case of the straightener as disclosed in the above-described Japanese utility model application published under SHOWA No. 39-17657, a straightener plate positioned along the axis of the straightening passage divides the straightening passage into a central passage portion and an outer periphery passage portion, the central passage portion has the same sectional area throughout its length, but the outer periphery passage portion disposed thereabout has its sectional area gradually reduced towards the downstream side, whereby the central passage portion and the outer periphery passage portion provide different straightening effects and manners of the fluid flow each other. Consequently, in this case also, the fluid straightening efficiency is low and it is impossible to prevent the generation of the vortex flow in the jetted fluid. However, if it is attempted to dispose the straightening plate with an inclination in order to equalize the straightening effects in the respective passage portions, there will occur considerable complication in the structure of the straightener and cost increase of the same.

SUMMARY OF THE INVENTION

Therefore, it is the object of the present invention to provide a descaling nozzle which is superior in preventing the irreguralities in the jetted fluid flow and at the same time which is inexpensive to manufacture.

For accomplishing the above-stated object, the descaling nozzle related to the present invention comprises a straightening passage having the same radius throughout its length and a constricted passage having a radius gradually reduced from an upstream end thereof towards or adjacent a downstream end thereof. Functions and effects of these features will be described next.

Since the straightening passage has the same radius throughout or substantially throughout its length, it is possible to employ such a straightener as of a simple construction in which an outer peripheral edge of the straightener coming into contact with the peripheral wall of the straightening passage is disposed in parallel with the axis of the straightening passage and the straightening plate is disposed along the axis of the straightening passage. And, at the same time, it is possible that all of the respective passage portions divided by the straightener have the same passage section area throughout or substantially throughout their total length. As the result, the straightener may be readily and inexpensively manufactured and also the straightening passage may achieve high fluid straightening performance.

Moreover, since the constricted passage communicating with the straightening passage has a radius gradually reduced from an upstream end thereof towards or adjacent a downstream end thereof, the passage section area of the constricted passage , at a position adjacent the straightening passage, becomes equal to that of the straightening passage incorporating the straightener. As 9 result, the generation of the vortex in accordance with the entrance of the fluid from the straightening passage into the constricted passage may be prevented, whereby the fluid enters a jetting passage as maintaining the straightened state thereof created through the straightening passage.

Consequently, the present invention has provided an inexpensive descaling nozzle achieving a highly efficient and reliable descaling performance through the increase and equalization of jetting pressure by quickly straightening the fluid flow and efficiently maintaining this straightened flow state.

Especially, as will be described later in the description of the preferred embodiments, if such a straightener is employed as having a plurality of straightening plates interconnected and spaced radially along the axis of the straightening passage with the plates having conical projections formed on a central and axial end face thereof, the nozzle achieves still higher fluid-straightening efficiency as will be proved by results of experiments to be described later.

BRIEF DESCRIPTION OF THE DRAWINGS

The accompanying figures FIG. 1 through FIG. 10 show preferred embodiments of the present invention; in which, FIG. 1 is a vertical section, FIG. 2 is a perspective view of a straightener, FIG. 3 is a plane view, FIG. 4 is a bottom view, FIG. 5 is a vertical section of a filter, FIG. 6 is a vertical section, FIG. 7 is a side view of the straightener, FIG. 8 is a schematic view showing construction of an experiment device, FIGS. 9(*a*) through 9(*c*), FIGS. 10(*a*) through 10(*c*), FIGS. 11(*a*) through 11(*g*) and FIGS. 13(*a*) through 13(*c*) are graphs showing distributions of collisional pressure in the respective experiments.

DESCRIPTION OF THE PREFERRED EMBODIMENTS

Preferred embodiments of the present invention will be particularly described hereinafter with reference to the accompanying drawings.

Figure 1:
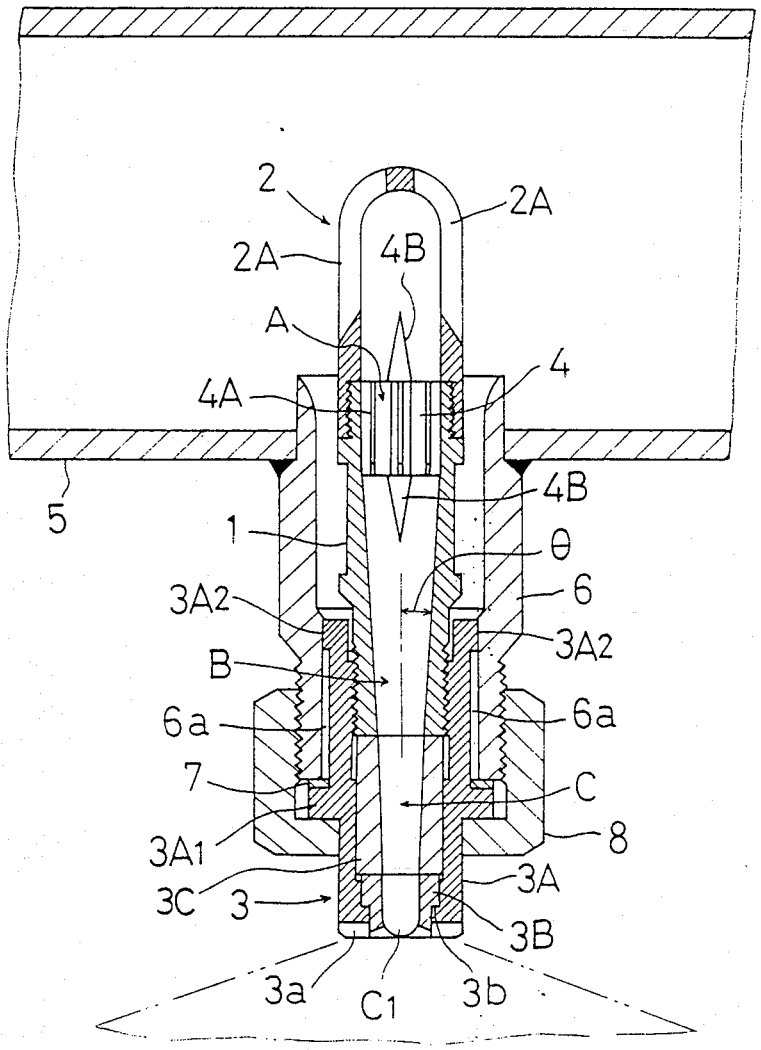

In FIG. 1, there is shown a descaling nozzle for eliminating scale formed on a surface of a rolled steel plate through a linear jetting operation of highly-pressurized water onto the surface. Referring to the same figure, this descaling nozzle comprises a cylindrical passage forming member 1, a filter 2 screwedly engaged with one end of the passage forming member 1 and a jetting passage forming member 3 screwedly engaged with the other end of the passage forming member 1.

The passage forming member 1 forms a straightening passage 'A' and a constricted passage 'B' communicating with downstream of the straightening passage 'A' with axes of the passages being aligned on the same straight line. More particularly, the inner radius of the nozzle is the same (i.e. cylindrical) from the upstream end of the straightening passage 'A' to the vicinity of the downstream end of the same, and from adjacent this downstream end of the straightening passage 'A' to the vicinity of the downstream end of the constricted passage 'B', the radius gradually tapers (i.e. conical) and further the radius again remains the same from adjacent this downstream end of the passage 'B' to a further end of the nozzle. Specifically, the inclination angle $\theta$ of the peripheral face of the constricted passage 'B' relative to the axis of the passage 'B' is actually 3° 45° when the constricted passage 'B' has a radius of 13 mm at the upstream end thereof and a radius of 7.6 mm at the downstream end thereof and has a length of 54 mm. Further, the straightening passage 'A' incorporates a straightener 4.

Figure 2:
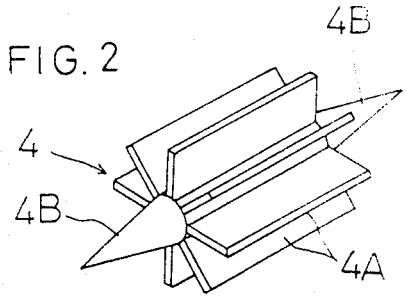

This straightener 4, as shown in FIG. 2, is disposed along the axis of the straightening passage 'A' and has a plurality of radially spaced straightening plates 4A of the same length as the straightening passage 'A' and conical projections 4B formed centrally at the both ends of the plates 4A. A portion of the straightening plate 4A to be engaged into the upstream end to the downstream end of the straightening passage has an outer periphery formed to be parallel with the axis of the straightening passage 'A' such that the outer periphery may come into contact with this straightening passage portion throughout its whole length. Further, a further portion of the straightening plate 4A to be engaged into a further portion of the straightening passage more downstream than the above downstream end has an outer periphery gradually inclined in the downstream direction towards the axis of the straightening passage 'A' such that this outer periphery may come into contact with the peripheral wall of the further straightening passage portion. The actual length of the straightening plate 4A is, for example, 16 mm when the constricted passage 'B' has the aforementioned specifications.

Figure 3:
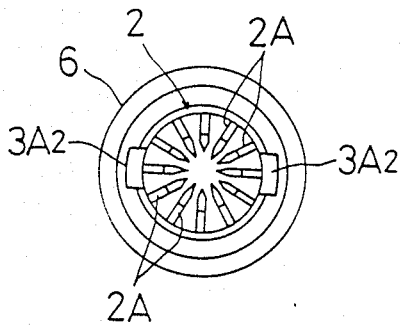

The filter 2, as shown in FIG. 3, has a cap-like configuration and defines a plurality of vertical slits 2A dispersed in the peripheral direction from a dome-shaped top portion thereof to a vertically intermediate position.

Figure 4:
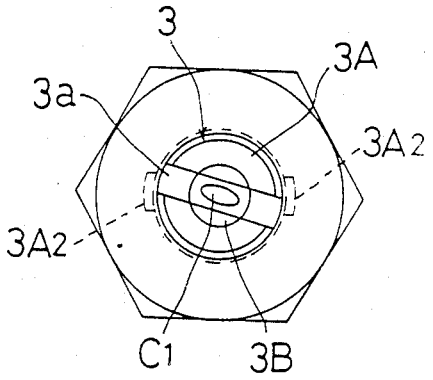

The jetting passage forming member 3, with the attachment of the passage forming member 1, forms a jetting passage 'C' communicating with the downstream end of the constricted passage 'B' with its axis being positioned on the same straight line as that of the constricted passage 'B' A jetting opening C1 of the jetting passage 'C' is provided at a bottom portion of a groove 3*a* defined diametrically in a leading face of the jetting passage forming member 3. This jetting passage forming member 3, as shown in FIG. 4, includes a screw-mounting portion for the passage forming member 1, a nozzle case 3A forming end portions of the groove 3*a*, a nozzle chip 3B fixedly attached inside the nozzle case 3A and forming the jetting opening C1 and a central portion of the groove 3*a*, and a bush 3C also fixedly attached inside the nozzle case 3A and forming a portion of the jetting passage 'C' extending to the nozzle chip 3B.

The nozzle chip 3B is made of highly wear-resistant sintered hard alloy such as tungsten carbide alloy. The nozzle chip 3B and the nozzle case 3A respectively define step portions 3*b* for preventing the nozzle chip 3B from coming off to the top side thereof. That is to say, the nozzle chip 3B is inserted by applying pressure thereto into the nozzle case 3A from its bottom end side and fixedly attached therein. A passage portion of the jetting passage 'C' disposed inside the bush 3C has a radius gradually and linearly reduced towards the downstream side.

The descaling nozzle body is inserted into and attached to an adaptor 6 branched from a main pipe 5 with the filter 2 being positioned inside the main pipe 5. To described more particularly this attachment construction, the nozzle case 3A includes a flange 3A1 which comes into contact with an end face of the adaptor 6 through a packing 7 thereby regulating axial positioning of the nozzle and a projection 3A2 which comes into engagement with a groove 6*a* defined in an inner peripheral face of the adaptor 6 thereby regulating positioning of the nozzle about the axis, and further there is provided a fixing cap nut 8 which comes into screwed engagement with the adaptor 6 thereby urging the flange 3A1 toward its end face side.

Alternate embodiments of the present invention will be described next.

(1) In the above-described embodiment, the nozzle is attached to the main pipe 5 through the adaptor 6. In place of this, the nozzle may be attached to the main pipe directly as well.

Figure 5:
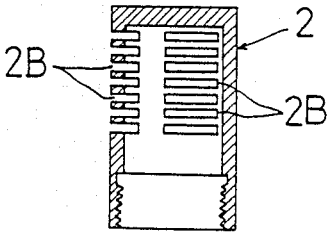

(2) In the above embodiment, the filter 2 has a plurality of vertical slits 2A. In place of this, as shown in FIG. 5, the filter 5 may have a plurality of lateral slits 2B disposed peripherally, or may have a plurality of pores. That is to say, in the case of the present invention, the shape and construction of the filter 2 may be conveniently varied.

Figure 6:
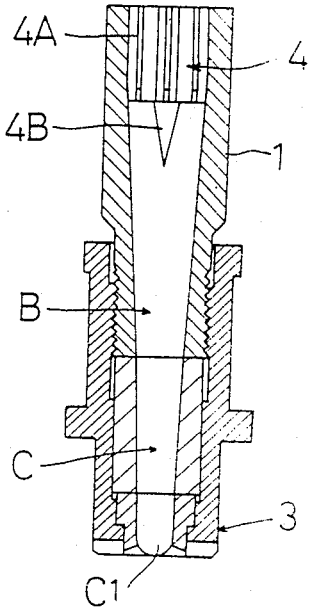

(3) The descaling nozzle disclosed in the above embodiment comprises the filter 2. However, as shown in FIG. 6, a descaling nozzle having no filter also falls within the scope of the present invention.

Figure 7:
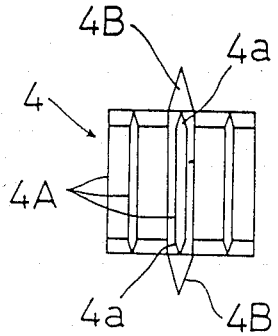

(4) As shown in FIG. 7, in the straightener 4 disclosed in the above embodiment, the axially end portions 4*a* of the straightening plates 4A may be formed pointed as well.

(5) In the above embodiment, the straightener 4 has 8 straightening plates 4A. Alternately, the number of straightening plate may be conveniently varied such as 4 or 6 and so on.

(6) In the above embodiment, the straightener 4 has the projection 4B. This projection 4B of the straightener 4 may be projected only at the upstream side; or as shown in FIG. 7, only at the downstream side. Further, it is also possible that the straightener 4 has no projection at all. It is to be noted that the straightener 4 having the projection 4B projected only at the downstream side is suitable for a nozzle having no filter 2.

(7) In the above embodiment, the straightener 4 has a plurality of radially spaced and interconnected straightening plates 4A. In place of this, these straightening plates 4A may be spaced and interconnected in the form of mesh when seen from the direction of the axis. That is to say, the shape and construction of the straightener 4 may be conveniently varied.

(8) In the above embodiment, the straightening passage 'A' has the same radius from its upstream end to the vicinity of its downstream end. In place of this, the straightening passage 'A' may have the same radius throughout its whole length.

(9) In the above embodiment, the constricted passage 'B' has its radius gradually reduced towards the downstream side from the upstream end to the vicinity of the downstream end. In place of this, the constricted passage 'B' may have the same radius throughout its whole length.

(10) The graduation of the reducing radius of the constricted passage 'B', i.e. the inclination angle $\theta$ of the peripheral face of the constricted passage 'B' relative to the axis may be either larger or smaller than the actual value disclosed in the above embodiment.

(11) The lengths of the straightening passage 'A' and the straightener 4 may be conveniently varied.

Nextly, experiment results will be particularly described.

Figure 8:
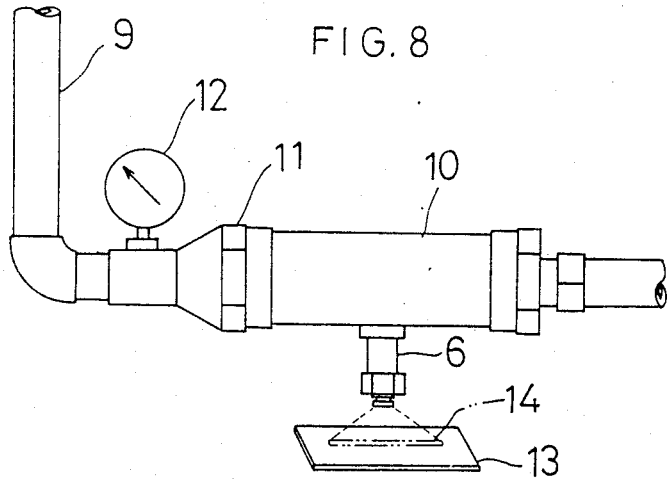

In the respective experiments to be described hereinafter, as shown in FIG. 8, a testing device was constructed as a header 10 was connected through a vortex flow generation reducer 11 to a laminar flow pipe 9 having a radius of 41.2 mm and a length of 2.5 m and as a Bourdon-tube type pressure gauge 12 was attached to the pipe 9 and further the nozzle was attached through the adaptor 6 to the header 10 as the main pipe 5. Then, jetted fluid flow through the nozzle was caused to collide a lead plate 13 thereby forming a groove 14 on the plate 13 under the basic conditions of 120 kgf/cm$^2$ jetting pressure, 106.6 l/min jetting flow amount and 300 mm jetting distance. And, based on the depths of the groove 14, distribution conditions of collisional force 'F' in the direction of thickness of the jetted flow were measured at a portion having 7 mm width centrally of the jetted flow width direction. It is to be noted that the unit of the collisional force 'F' is 1 mm$\phi$ and that the value comprises an average value obtained in six tests carried out under the same conditions.

EXPERIMENT EXAMPLE 1

Figure 9:
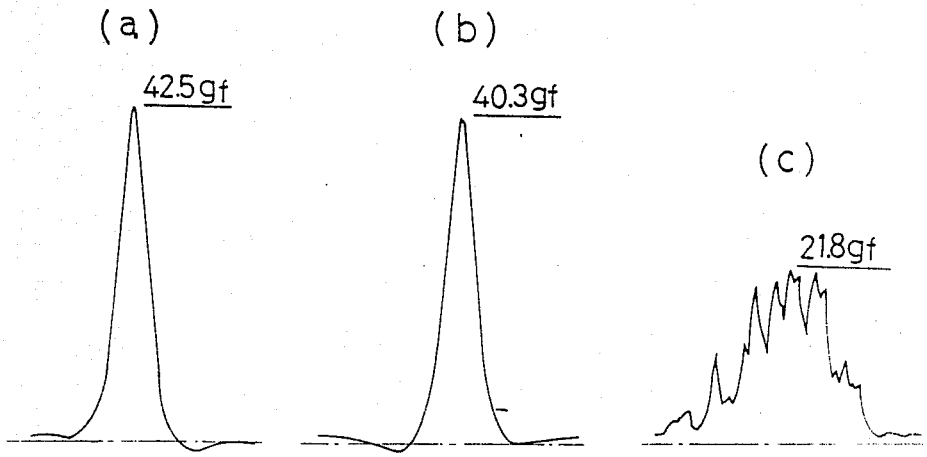

In this experiment example, a nozzle 'A' having the construction described in the above-described embodiment, a nozzle 'B' which has the same construction as the nozzle 'A' except that the nozzle 'B' has no filter and a nozzle 'C' which has the same construction as the nozzle 'B' except that the nozzle 'C' has no straightener 4, were used. The results with use of the nozzle 'A', the nozzle 'B' and of the nozzle 'C' are shown in FIGS. 9(*a*), 9(*b*) and 9(*c*), respectively.

The above results show that the straightener 4 decreased the thickness of the jetted flow thereby increasing the collisional force 'F' and show also that the filter 2 served to further increase the collisional force 'F'. This is probably because the fluid was preliminary straightened through the vertical slits 2A of the filter 2 before entering the straightening passage 'A'.

EXPERIMENT EXAMPLE 2

Figure 10:
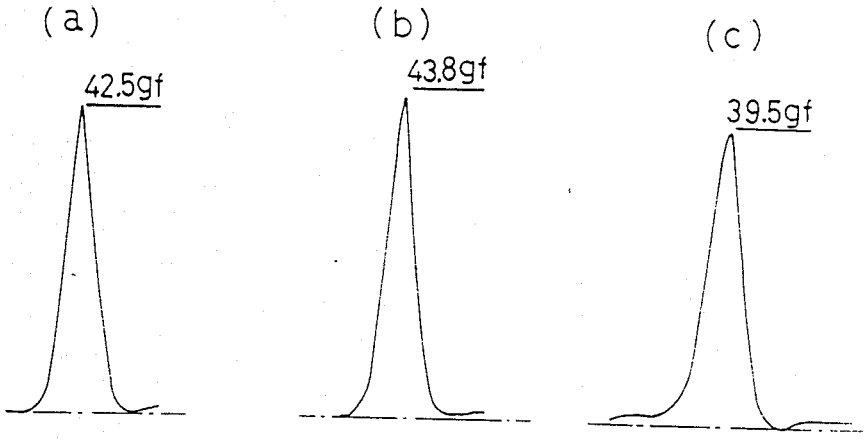

In this experiment example, the above-described nozzle 'A', a nozzle 'D' having the straightener 4 with its axially end portions 4*a* of the straightening plates 4A being formed pointed as described in one of the alternate embodiments, and a nozzle 1 E' having the straightener 4 having no projection 4B were used in order to test variations in the collisional force 'F' resulting from the different constructions of the straightener 4. The results with use of the nozzle 'A', the nozzle 'D' and of the nozzle 'E' are shown in FIGS. 10(*a*), 10(*b*) and 10(*c*), respectively.

The above results show that the nozzle performs best with the attachment of the straightener 4 having the projections 4*a*.

EXPERIMENT EXAMPLE 3

Figure 11:
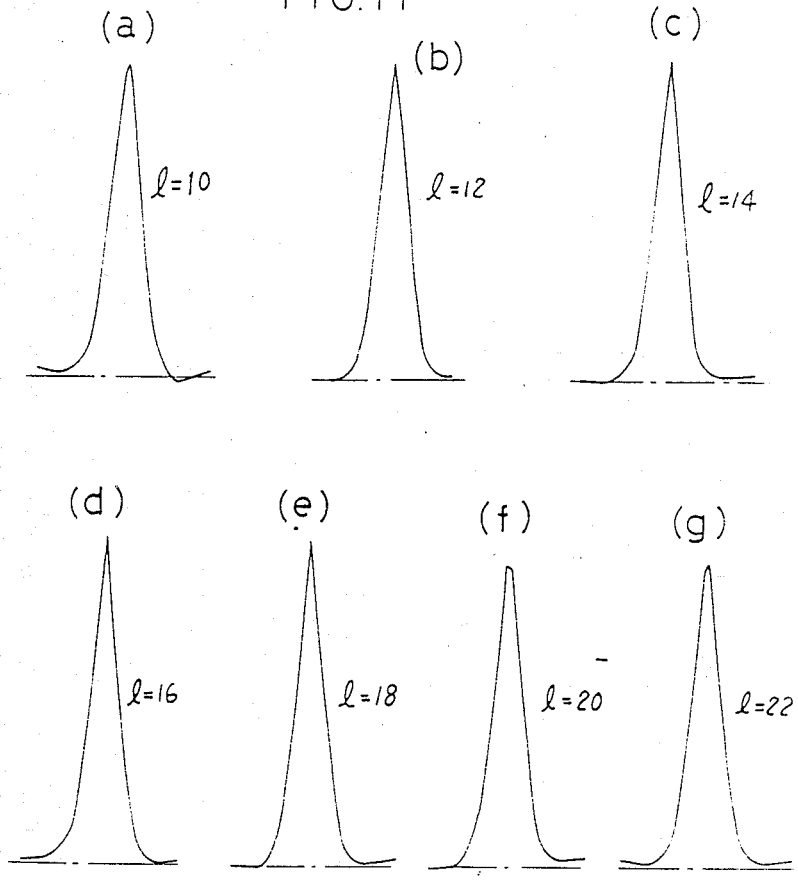
Figure 12:
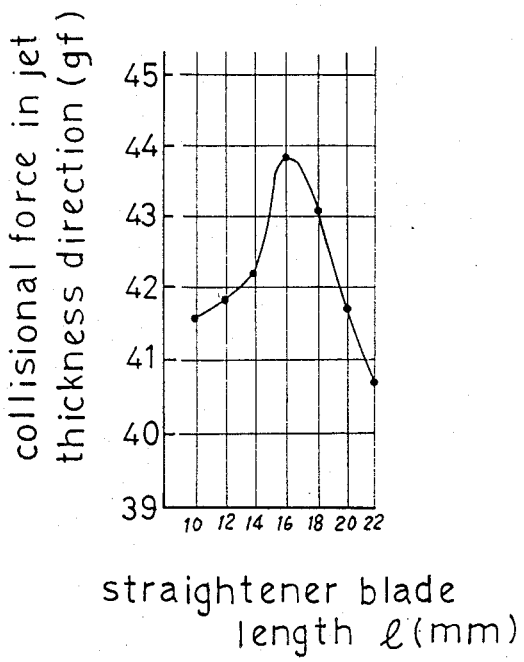
FIG. 12 is a graph showing a collisional force 'F'.

At this time, the experiments were carried out with the nozzle 'A' having the straightener 4 including the straightener plates 4A of different lengths, i.e. 10 mm, 12 mm, 14 mm, 16 mm, 18 mm, 20 mm and 22 mm, respectively. The respective results are shown in FIGS. 11(*a*) through 11(*e*) and in FIG. 12. These results show that the straightener plate 4A having the length of 16 mm is the best in terms of the collisional pressure 'F' and that the straightener 4 invariably performs well within the length range between 10 mm to 22 mm.

EXPERIMENT EXAMPLE 4

Figure 13:
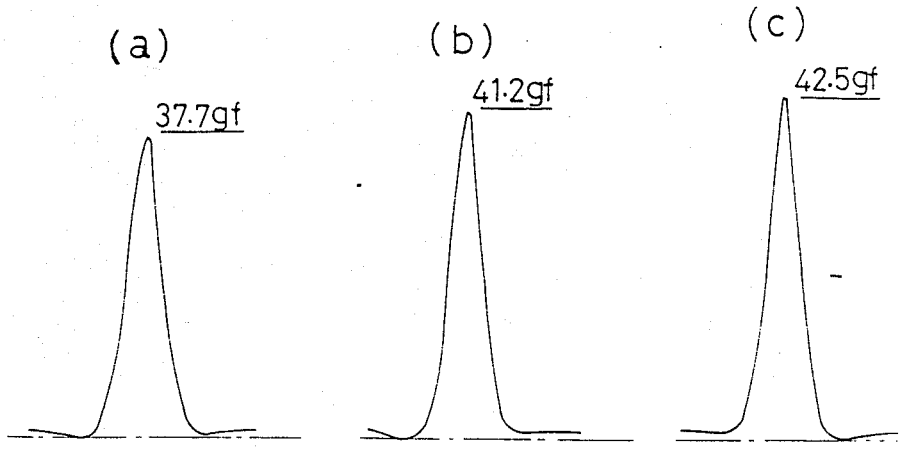

In this experiment, tests were carried out with varying the number of the straightening plates 4A of the straightener 4 of the nozzle 'A' to 4, 6 and then to 8. The respective results are shown in FIGS. 13(*a*) through 13(*c*). These results show that the nozzle performs best when the number of the straightening plates 4A of the straightener 4 is between 6 to 8. However, if the other conditions change, it is also possible to use the straightener 4 having 4 or more than 9 straightening plates 4A. In this experiment, the width of the groove 14, i.e. the thickness of the jetted flow was also checked, and the results show that the width was 12.5 mm in the case of 4 plates, 11.5 mm in the case of 6 plates and 11 mm in the case of 8 plates. This proves that the collisional force 'F' increases with a decrease in the thickness of the jetted flow.

What is claimed is:

1. A descaling nozzle comprising:

a straightening passage (A) incorporating a straightener (4) extending to a downstream terminal end thereof;

a constricted passage (B) formed continuously and flush with the downstream terminal end of said straightening passage (A);

a jetting passage (C) formed continuously and flush with the downstream terminal end of said constricted passage (B) and having a jetting opening (C1) at a bottom of a groove diametrically defined at a leading end face of the fitting passage;

the axes of said straightening, constricted and jetting passages the coaxial;

wherein:

said straightening passage (A) has the same radius through a whole or substantially a whole length thereof and said constricted passage (D) has a radius tapering from an upstream end thereof to the downstream terminal end thereof, said jetting passage (C) has a radius tapering from an upstream end thereof to the downstream end thereof, said straightener (4) includes a plurality of radially spaced straightening plates (4A) disposed along the axis of said straightening passage (A) and a conical projection (4B) formed at a downstream end face thereof and coaxial to said straightening plates 4(A), and said jetting, constricted an straightening passages in combination form a smooth continuous passage without any steps formed therein.

2. A descaling nozzle, as claimed in claim 1, wherein an inclination angle $\theta$ of a peripheral face of said constricted passage (B) relative to the axis of the passage (B) is 3° 45'.

3. A descaling nozzle as claimed in claim 1, wherein said straightener (4) includes a further conical projection (4B) formed at an upstream end face thereof and coaxial with said straightening plates (4A).

* * * * *